United States Patent [19]

Rosenthal et al.

[11] 4,385,983

[45] May 31, 1983

[54] PROCESS FOR RETORTING OIL SHALE MIXTURES WITH ADDED CARBONACEOUS MATERIAL

[75] Inventors: Joel W. Rosenthal, El Cerrito; P. Henrik Wallman, Berkeley, both of Calif.

[73] Assignee: Chevron Research Company, San Francisco, Calif.

[21] Appl. No.: 291,695

[22] Filed: Aug. 10, 1981

[51] Int. Cl.[3] ..... C10B 53/06; C10B 49/00; C10B 49/10

[52] U.S. Cl. ..... 208/11 R; 208/8 R

[58] Field of Search ..... 208/8 R, 11 R, 127

[56] References Cited

U.S. PATENT DOCUMENTS 4,125,157 11/1978 Ridley ..... 208/11 R
4,148,613 4/1979 Myers ..... 44/6
4,199,432 4/1980 Tamm et al. ..... 208/8 R

*Primary Examiner*—Delbert E. Gantz
*Assistant Examiner*—Glenn A. Caldarola
*Attorney, Agent, or Firm*—D. A. Newell; S. R. La Paglia; S. H. Roth

[57] ABSTRACT

A process for retorting oil shale, especially lean oil shale, which comprises heating oil shale in a retort zone in the absence of substantial molecular oxygen to evolve hydrocarbonaceous vapors therefrom, thereby producing retorted shale; burning the retorted shale with added carbonaceous material in a combustion zone in the presence of an amount of added combustion catalyst sufficient to increase the rate of combustion of said added carbonaceous material in said combustion zone; and transferring heat from the combustion zone to heat said lean shale.

12 Claims, 3 Drawing Figures

PROCESS FOR RETORTING OIL SHALE MIXTURES WITH ADDED CARBONACEOUS MATERIAL

BACKGROUND OF THE INVENTION

This invention relates to a process for retorting oil shale-coal mixtures and more particularly to a process for retorting mixtures of lean oil shale and coal.

Oil shale is a fine-grained, sedimentary rock which contains an organic material known as kerogen. Upon heating, kerogen decomposes to yield liquid oil, gases and residual carbon. The kerogen content varies with different geological formations, and some shale does not yield sufficient quantities of oil to economically justify its recovery. Unfortunately, some of the lower grades of oil shale must be mined in order to reach the richer deposits. Unless the oil can be extracted from these leaner resources, the overall costs of extraction will escalate needlessly.

Thermally efficient retorting systems use the energy of the residual carbonaceous material on the retorted shale for process heat. For example, the residual carbon may be burned to heat circulating solid heat carriers such as ceramic balls or particles, sand or spent shale. Alternatively, hot flue gases generated from the combustion can be used for direct or indirect heating of the raw shale.

The amount of carbonaceous residue remaining on the shale mineral structure after retorting is dependent upon various factors. At the temperatures required for commercial retorting, the primary factor is the grade or richness of the raw shale, with lower grades having proportionately less residue. For oil shales yielding less than about 0.13 liters of shale oil per kilogram of oil shale (30 gallons per ton), the quantity of organic residue in the retorted shale is insufficient to supply the total heat required for retorting the raw shale, when directly mixed in the preferred ratios of spent shale to raw shale.

It has been proposed to add supplementary carbonaceous material to the retorted shale in order to generate all or substantially all of the heat needed for heating the raw shale in the retorting zone. See, for example, U.S. Pat. Nos. 4,058,205; 3,939,057; 2,589,109; and the publication "Development of the Lurgi-Ruhr Gas Retort for the Distillation of Oil Shale," Lurgi Mineraloltechnik GMBH, Frankfurt (Main), October 1973, Page 11, Paragraph 5.

A particularly advantageous process for retorting oil shale and other similar materials is described in U.S. Pat. No. 4,199,432, issued Apr. 22, 1980 to Tamm et al, which is incorporated herein in its entirety by reference. In this process, fresh oil shale particles are passed into an upper section of a vertically-elongated retort and downwardly therethrough in the presence of hot heat carrier particles to heat the fresh oil shale particles to retorting temperatures sufficiently high to drive off hydrocarbonaceous materials, which are removed from the upper portion of the retort. A heated, nonoxidizing gas, e.g., recycled product gas, flue gas, nitrogen, or steam, is passed upwardly through the retort at a velocity of between about 1 to 5 feet per second. The size of the fresh oil shale particles and the heat carrier particles include particles which are fluidizable at the gas velocity and particles which are nonfluidizable at the gas velocity. The shale particles are passed downwardly through the retort at a rate providing a residence time for substantially complete retorting of the particles. The retort contains internals to substantially limit backmixing and slugging of the particles.

The retorted particles contain residual carbon. These particles are passed to a combustion zone where they are combusted with an oxygen-containing gas to heat the retorted particles along with any inert or spent shale particles present. The heated particles can then be recycled as heat carriers to the retort to provide process heat for retorting fresh shale particles. The combustion zone can be a liftpipe or an entrained bed reactor wherein the entrained particles are rapidly heated to combust residual carbonaceous material. To minimize the height of the liftpipe combustor, it is desirable to have a low combustor residence time of both gas and solids, e.g., less than about 4 seconds, preferably 1 to 2 seconds.

SUMMARY OF THE INVENTION

It is an object of this invention to provide an improved process for oil shale retorting which involves the addition of supplemental carbonaceous material to provide heat for retorting shale. It is a further object to provide improvement in the process of retorting mixtures of low-grade oil shale and other carbonaceous materials wherein a portion of the retorting heat requirement is met by burning the supplementary carbonaceous material. These and other objectives are met according to this invention in a process for retorting oil shale, especially lean oil shale, comprising:

(a) heating said oil shale in a retort zone in the absence of substantial molecular oxygen to evolve hydrocarbonaceous vapors therefrom, thereby producing retorted shale;

(b) burning said retorted shale with added carbonaceous material in a combustion zone in the presence of an amount of added combustion catalyst sufficient to increase the rate of combustion of said added carbonaceous material in said combustion zone; and (c) transferring heat from the combustion zone to heat the oil shale.

The added carbonaceous material can be coal, including anthracite, bituminous or sub-bituminous lignite, peat, oils such as petroleum, heavy petroleum fractions, retorted shale oil, coal-derived oils, wood chips, sawdust, coke, tar, or devolatilized coal, e.g., coal char, or any other carbonaceous fuel. The "added combustion catalyst" is defined as catalytic material in addition to any material already naturally present in the oil shale or carbonaceous feed to the process. The heat can be transferred from the combustion zone to the retort zone by passing to the retort spent, combusted shale particles, which can contain ash from the added carbonaceous material. Alternately, some or all of the heat can be transferred indirectly by passing a fluid, e.g., flue gas, from the combustor to the retort.

DETAILED DESCRIPTION OF THE INVENTION

As used herein, the term "oil shale" refers to fine-grained, sedimentary inorganic material which is predominantly clay, carbonates and silicates in conjunction with organic matter composed of carbon, hydrogen, sulfur, oxygen, and nitrogen and called "kerogen."

The term "retorted shale," as used herein, refers to oil shale from which most or essentially all of the volatilizable hydrocarbons have been removed and which may still contain carbonaceous residue.

The term "spent shale," as used herein, refers to retorted shale from which a substantial portion of the carbonaceous residue has been removed, for example, by combustion in a combustion zone.

The term "shale oil" refers to the hydrocarbonaceous material volatilized from the oil shale during retorting.

The term "devolatilized coal," as used herein, refers to coal from which a substantial portion of the volatilizable hydrocarbons have been removed, e.g., char.

The terms "condensed," "noncondensable," "normally gaseous," or "normally liquid," are relative to the condition of the subject material at a temperature of 25° C. (77° F.) and at a pressure of one atmosphere. Particle size, unless otherwise indicated, is measured with respect to Tyler Standard Sieve sizes.

According to this invention, it has been found that the combustion rate of retorted oil shale is significantly more rapid than the combustion rates of many other carbonaceous materials such as coal, shale oil and petroleum coke, and heavy oils, etc. Consequently, when retorted oil shale is combusted in the presence of the supplementary carbonaceous materials, e.g., carbonaceous materials not already present in the raw oil shale feed, a residence time must be provided which is greater than that necessary for combusting the retorted shale, e.g., by employing a larger combustion zone. The problem of differential combustion rates is particularly serious when retorted shale and added carbonaceous material are combusted in an entrained bed combustor which operates with a very low residence time, e.g., on the order of a few seconds such as that described in the aforementioned U.S. Pat. No. 4,199,432.

Figure 1:
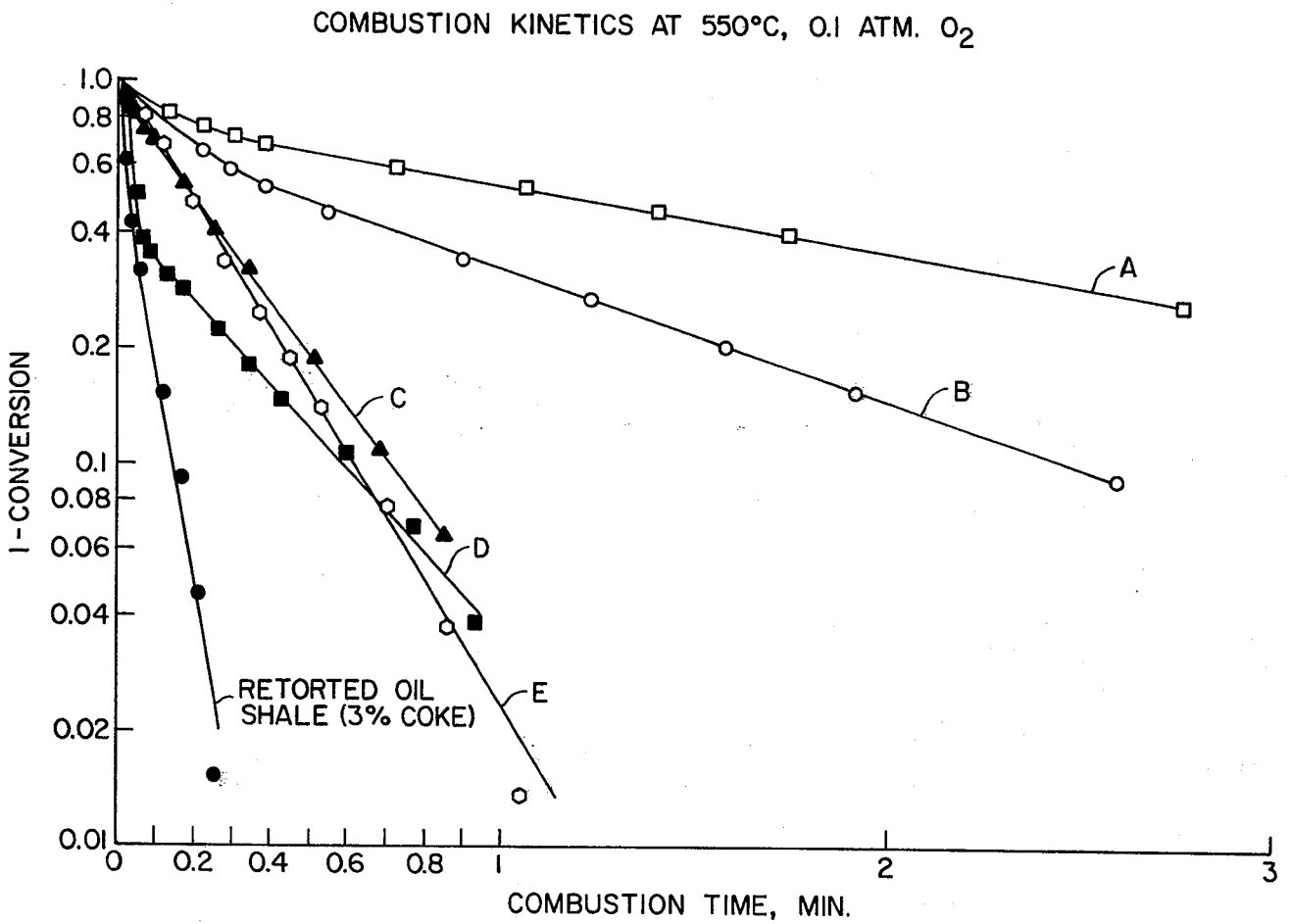
FIG. 1 is a diagram showing the conversion versus combustion time for retorted oil shale and other carbonaceous materials.

FIG. 1 depicts the relative combustion kinetics of retorted oil shale, containing 3% coke, and five other carbonaceous materials, as shown in Table 1.

TABLE 1

| Material | Description |
|---|---|
| A | 510° C. + Shale Oil Coke<br>37% Coke Yield |
| B | Illinois #2 Bituminous Coal |
| C | Platinum-Promoted FCC Coke |
| D | Spent Shale with 13% Deposited<br>Coke from a 230° C. + Petroleum VGO |
| E | Noonan Lignite |

The combustion tests were performed in a packed bed reactor under essentially isothermal conditions. The reactor contained a removable screen with glass wool packing. The packing supported a thin bed of the carbonaceous particles, mixed with inert alundum particles. In each experiment, the tube was heated up under a flow of inert gas and then was switched to a oxygen-containing gas for the combustion. The alundum particles served to keep the burning sample essentially isothermal. Combustion rates were determined by monitoring carbon dioxide production. In Sample B (bituminous coal), it is assumed that some volatilization occurred during the heat-up period, but this volatilization is ignored for purposes of the experiment. As shown in FIG. 1, the retorted oil shale had a markedly higher combustion rate than the other carbonaceous materials. It is believed that the high combustion rate of the retorted shale is the result of catalysis by noncombustible mineral matter present in the shale, especially calcium carbonates.

According to this invention, a combustion catalyst is added to the shale retorting process so that retorted shale and supplemental carbonaceous material are burned in the combustion zone in the presence of the added catalyst. The added catalyst need be present only in an amount sufficient to increase the rate of combustion of the supplemental carbonaceous material in the combustion zone. Preferably, the added catalyst is sufficiently active and is present in a sufficient amount to increase the combustion rate of the added carbonaceous material to near or above the combustion rate of the retorted shale.

The combustion catalyst added according to this invention can be any of the catalytically-active metals which enhance combustion of carbonaceous materials such as catalytically-active metals or catalytically-active metal compounds, e.g., oxides, carbonates or hydroxides of metals selected from Groups Ia, IIa, and the transition elements as described in the Periodic Table of the Elements, *Handbook of Chemistry and Physics,* Chemical Rubber Co. (1964). Of course, the combustion catalyst should preferably be inexpensive enough to be discarded because separation of used catalyst from large quantities of combustion materials would be very costly. Most preferred combustion catalysts are carbonates, hydroxides or oxides of alkali or alkaline earth metals, especially carbonates and hydroxides of sodium, potassium, calcium or magnesium.

The combustion catalyst can be added directly to the combustion zone, or can be added with the supplementary carbonaceous material to the process, or can be added anywhere else in the process, so long as the combustion catalyst is present and active in the combustion zone. Preferably, the supplementary carbonaceous material is contacted with the combustion catalyst prior to addition to the process, e.g., to the retort zone or to the combustion zone. When a solid supplementary carbonaceous material, such as coal, is added, the coal can be pretreated by contacting it with a solution or suspension of the combustion catalyst, for example, in an aqueous solution. The treatment of coal with inorganic agents prior to combustion is described in U.S. Pat. No. 4,148,613, "Process for Preparing Sulfur-Containing Coal or Lignite For Combustion," which is incorporated herein in its entirety by reference.

Preferably, the catalyst is added in as small quantities as possible so that it can be discarded with the spent shale. The minimum effective amount for any given catalytic agent will depend upon the particular carbonaceous material added and upon the particular catalyst, and can be determined by routine testing. For example, when $K_2CO_3$ or $Na_2CO_3$ is used as a combustion catalyst with bituminous coal, about 1 to 20 pounds of catalyst per ton of coal should be sufficient to significantly enhance combustion. When $K_2CO_3$ or $Na_2CO_3$ is used with added retorted shale oil, about 0.25 to 5 pounds of catalyst per barrel of added shale oil should be sufficient.

A suitable impregnant solution for coal and other solid carbonaceous materials can be a 1 to 20 weight percent solution of $Na_2CO_3$, $K_2CO_3$, NaOH or KOH dissolved or suspended in water.

The following specific embodiments demonstrate the addition of coal as a solid supplemental carbonaceous material and retorted shale oil as a liquid supplemental carbonaceous material. These embodiments are intended to be illustrative only and can be modified in various ways by one skilled in the shale retorting art without departing from the scope of this invention.

SPECIFIC EMBODIMENT 1

Figure 2:
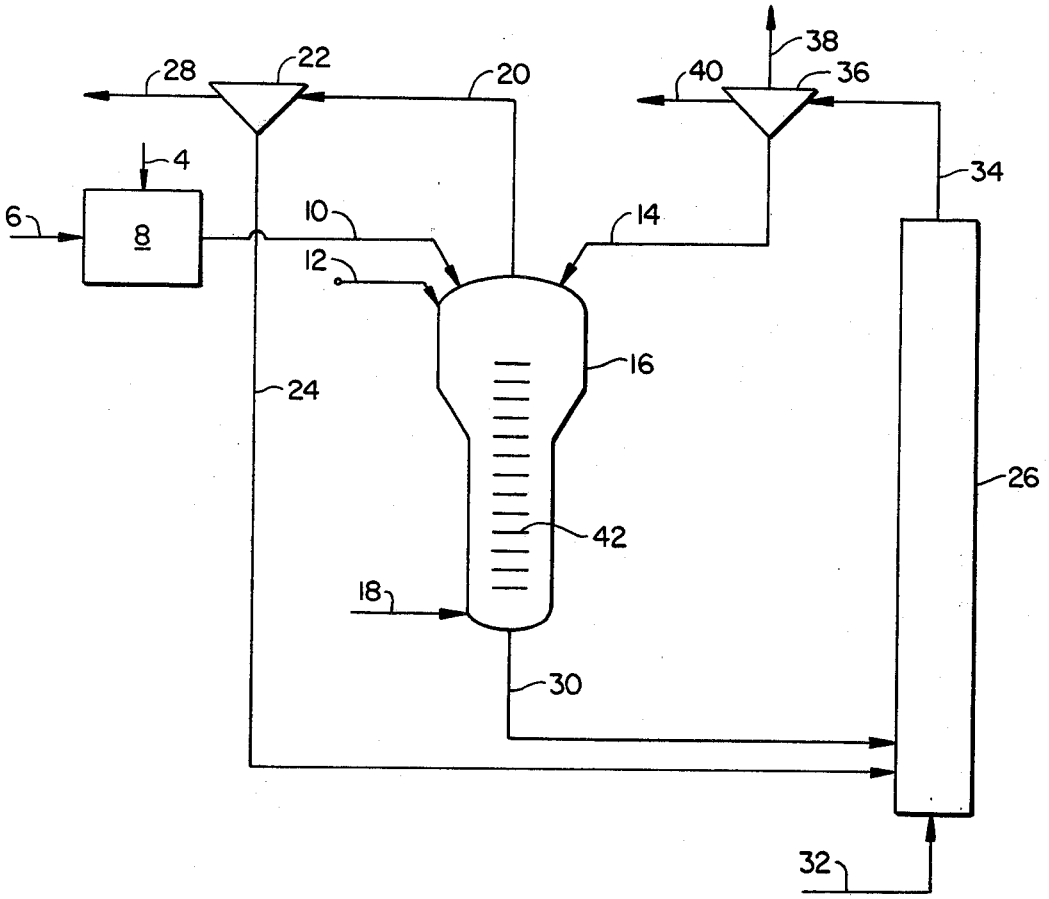
FIG. 2 is a flow diagram of a process in which a solid supplementary carbonaceous material is added to the retort.

Referring to FIG. 2, raw coal is introduced through line 6 and an aqueous solution of sodium carbonate is added through line 4 to mixing zone 8 wherein the coal is impregnated with the sodium carbonate. The catalyst-treated coal, raw oil shale particles, and hot spent shale particles are introduced through lines 10, 12 and 14, respectively, into an upper portion of a vertically-elongated retort 16 and pass downwardly therethrough. A stripping gas substantially free of molecular oxygen (e.g., steam) is introduced via line 18 to a lower portion of retort 16 and is passed upwardly through the retort, fluidizing a portion of the shale and coal particles. Hydrocarbonaceous materials retorted from the raw oil shale and coal particles, stripping gas, and entrained fines are withdrawn overhead from an upper portion of retort 16 through line 20. The entrained fines are separated in zone 22 from the hydrocarbonaceous material and stripping gas, and the fines pass via line 24 to a lower portion of combustor 26. Alternatively, the entrained fines could be returned to a lower section of retort 16 if desired. The effluent retorted shale particles and coal char particles are removed from a lower portion of retort 16 through line 30 and also pass to the lower portion of the combustor 26. The retorted hydrocarbonaceous materials and stripping gas pass from zone 22 through line 28 for downstream processing to the ultimate product such as fuel oil, diesel, gasoline, and jet fuels.

Air is introduced into a lower portion of combustor 26 through line 32 and provides oxygen to burn the organic residue on the effluent retorted shale particles, the coal char and fines. The combustor heats the previously retorted shale which is removed with the flue gas from an upper portion of the combustor through line 34 and passes to separation zone 36. A portion of the spent shale, preferably larger than about 200 mesh in size, is recycled from separation zone 36 through line 14 to retort 16 to provide process heat. Hot flue gas, fly ash, and the excess spent shale fines pass from separation zone 36 through lines 38 and 40, respectively.

The maximum particle size for the solids introduced in the top of the retort 16 is at or below about 2½ mesh (Tyler Standard Sieve size). Particle sizes in this range are easily produced by conventional means such as cage mills, or jaw or gyratory crushers. Crushing operations may be conducted to produce a maximum particle size, but little or no control is effected over the smaller sizes produced. This is particularly true in regard to shale which tends to cleave into wedge-shaped fragments.

The temperature of the spent shale introduced to the retort via line 14 will normally be in the range of 600° C. to 800° C., depending upon the selected operating ratio of heat carrier to shale. The fresh shale may be introduced at ambient temperature or preheated if desired to reduce the heat transfer required between fresh shale and heat carrier. The temperature at the top of the retort should be maintained within the broad range of 450° C. to 540° C. and is preferably maintained in the range of 480° C. to 510° C.

The weight ratio of spent shale heat carrier to raw oil shale and coal may be varied to approximately 1.5:1 to 8:1, with a preferred weight ratio in the range of 2.0:1 to 3:1. It has been observed that some loss in product yield occurs at the higher weight ratios of spent shale to fresh shale. It is believed that the cause of such loss is due to increased adsorption of the retorted hydrocarbonaceous vapor by larger quantities of spent shale. Furthermore, attrition of the spent shale, which is an actual consequence of retorting and combustion of the shale, occurs to such an extent that high recycle ratios cannot be achieved with spent shale alone. If it is desired to operate at higher weight ratios of heat carrier to fresh shale, an auxiliary attrition resistant material such as sand may be substituted as part or all of the heat carrier.

The mass flow rate of fresh oil shale and coal to the retort should be maintained between 4,900 kg/hr-m$^2$ and 29,300 kg/hr-m$^2$, and preferably between 9,800 kg/hr-m$^2$ and 19,600 kg/hr-m$^2$. Thus, in accordance with the broader recycled heat carrier weight ratios stated above, total solids mass rate will range from approximately 12,200 kg/hr-m$^2$ to 261,000 kg/hr-m$^2$.

A stripping gas, preferably steam, is introduced via line 18 into a lower portion of the retort and passes upwardly through the vessel in countercurrent flow to the downwardly moving solids. The flow rate of the stripping gas should be maintained so as to produce a superficial gas velocity at the bottom of the vessel in the range of approximately 30 cm per second to 150 cm per second, with a preferred superficial velocity in the range of 30 cm per second to 60 cm per second. Stripping gas may be comprised of steam, recycled product gas, hydrogen, or any inert gas. It is particularly important that the stripping gas be essentially free of molecular oxygen to prevent product combustion within the retort.

The stripping gas will fluidize those solids having a minimum fluidization velocity less than the velocity of the stripping gas. Those particles having a fluidization velocity greater than the gas velocity will pass downwardly through the retort generally at a faster rate than the fluidized particles. Limiting the maximum bubble size and the vertical backmixing of the downwardly moving solids produces stable, substantially plugflow conditions through the retort volume. True plugflow, wherein there is little or no vertical backmixing of solids, allows much higher conversion levels of kerogen to vaporized hydrocarbonaceous material and cannot be obtained, for example, in a fluidized bed retort with gross top to bottom mixing. In conventional fluidized beds, as in stirred-type tank reactors, the product stream removed approximates the average conditions in the conventional reaction zone. Thus, in such processes, partially retorted material is necessarily removed with the product stream, resulting either in reduced product yield or a larger reactor volume giving much longer average particle residence times. Maintaining substantially plugflow conditions by substantially limiting top to bottom mixing of solids allows one to operate the process on a continuous basis with a much greater control of the residence time of individual particles. The use of means for limiting substantial vertical backmixing of solids also permits a substantial reduction in size of the retort required for a given mass throughput so that the chances for removing partially retorted solids with the retorted solids are reduced. Means for limiting backmixing and limiting the maximum bubble size, indicated by numeral 42, may be generally described as barriers, baffles, dispersers or flow redistributors or may, for example, include spaced horizontal perforated plates, bars, screens, packing, or other suitable internals. A preferred baffle system is described in copending U.S. patent application Ser. No. 145,290, filed Apr. 30, 1980, for "Baffle System For Staged Turbulent Bed" by Spars et al, which is incorporated herein in its entirety by reference.

Gross vertical backmixing should be avoided, but highly localized mixing is desirable for purposes of heat transfer in that it increases the degree of contacting between the solids and the solids and gases. The degree of backmixing is, of course, dependent on many factors but is primarily dependent on the particular internals or packing disposed within the retort.

The product effluent stream comprised of hydrocarbonaceous material, admixed with the stripping gas, is removed from the upper portion of the retort by conventional means through line 20 and passes to the separation zone 22. The product effluent stream will contain entrained fines and it is preferred that said fines be separated from the remainder of the stream at this juncture. The separation can be effected by any suitable or conventional means such as cyclones, pebble beds, and/or electrostatic precipitators. Preferably, the fines which are separated from the product effluent stream pass via line 24 to the combustor 26. The product effluent passes from the separation zone via line 20 to appropriate downstream processing to make the final products.

As the raw oil shale is pyrolyzed in the retort, the kerogen is decomposed and driven off in the vapor state, leaving an organic residue on the mineral structure. The amount of carbonaceous matter remaining is dependent upon various factors. At the temperatures required for commercial retorting, the primary factor is the grade or richness of the raw oil shale. When Green River kerogen is pyrolyzed at 500° C., it yields approximately 62 weight percent oil, 13 weight percent gas, 8 weight percent water, and 17 weight percent carbon residue. The lower grade shales will have proportionately less organic residue. For oil shales yielding less than about 0.13 liters per kilogram, the quantity of organic residue can be insufficient to supply the total heat requirement for retorting the raw shale when directly mixed in the preferred ratios of 2:1 to 3:1 of spent shale to raw shale and coal after combustion of the carbon residue.

The coal char comprised primarily of carbon and ash provides additional energy required to heat the spent shale. While combustor 26 may be of conventional design, it is preferred that it be a dilute-phase, liftpipe combustor of the type described in copending application Ser. No. 246,555, filed Mar. 23, 1981 in the name of Bertelsen, entitled "Process for Burning Retorted Shale and Improved Combustor," incorporated herein in its entirety by reference. Air is injected into the lower portion of the combustor via line 36 and the organic residue on the shale and the coal char is burned. Since the coal char contains sulfur, the combustion thereof results in the formation of $SO_2$. The $SO_2$ reacts with calcium and magnesium oxides produced by the decomposition of the respective carbonates in the shale minerals. Preferably, the combustion zone contains a sufficient ratio of retorted shale to coal to absorb substantially all of the $SO_x$ in the absence of added combustion catalyst. If the raw shale does not have sufficient initial carbonate content to absorb the $SO_2$, additional carbonates or oxides, for example, may be admixed with the feed shale. If the carbonates or oxides are also to function as combustion catalysts, they should preferably be added in excess, at least 5% excess of the amount needed to absorb substantially all of said $SO_x$.

The combustion heats the retorted shale to a temperature in the range of 600° C. to 800° C. and the hot shale, coal, fly ash and flue gas are removed from the upper portion of the combustor via line 34 and pass to separation zone 36. A portion of the hot spent shale is recycled via line 14 to provide heat for the retort. Preferably, said recycled shale is classified to remove substantially all of the −200 mesh shale fines and coal ash prior to introduction to the retort in order to minimize entrained fines carry-over in the effluent product vapor. Hot flue gases are removed from the separation zone via line 38 and excess spent solids are passed from the zone via line 40. The clean flue gas and/or spent solids passing from zone 36 via lines 38 and 40 may be used to provide heat for steam generation or for heating process streams. An alternative solution is to introduce the catalyst-treated crushed raw coal directly to the bottom of the lift combustor. This approach burns the volatile content of the coal along with the fixed carbon content or char of the coal, but increases the total fresh shale retorting capacity. Such a route may be preferable with caking coals or low volatile coals.

The following amounts of coal, on a moisture- and ash-free basis, are required for heat balancing the retort for the specified shale grades at a weight ratio of spent shale to fresh shale of 2.5:1.

TABLE 2

| Shale Grade (liter/kg) | Coal Fed To Combustor (kg coal/kg shale) | Coal Fed To Retort (kg coal/kg shale) |
|---|---|---|
| 0.083 | 0.013 | 0.022 |
| 0.104 | 0.007 | 0.012 |
| 0.126 | 0.001 | 0.002 |

SPECIFIC EMBODIMENT 2

Figure 3:
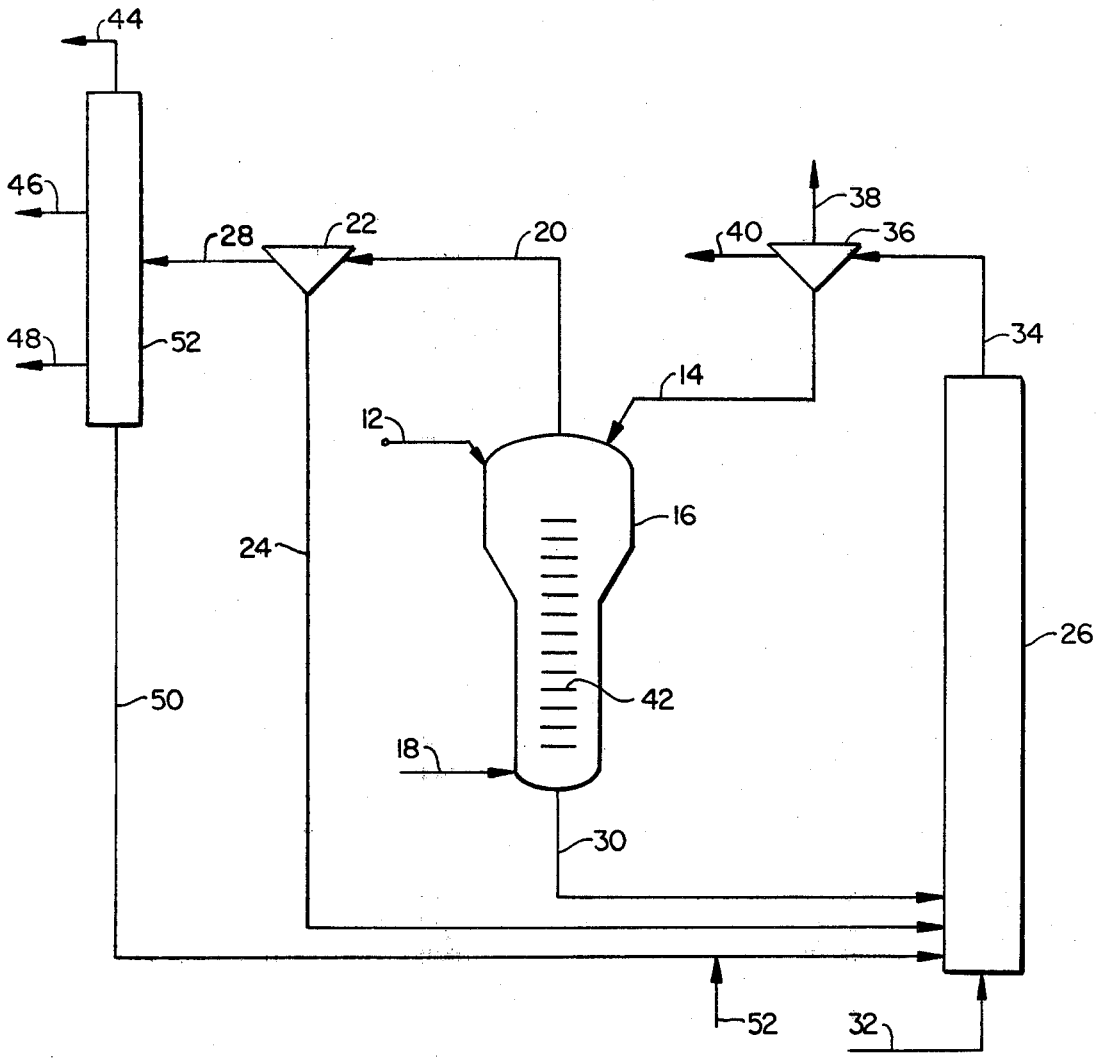
FIG. 3 is a flow diagram of a process in which retorted shale oil is added as a supplementary carbonaceous material to the combustor.

Referring to FIG. 3, the system of FIG. 2 is modified to provide for retorted shale oil as a supplemental carbonaceous material to the combustor. The components of FIG. 3 common to FIG. 2 are shown with the same reference numerals and operate in the same manner.

Product effluent from separator 22 passes through line 28 to distillation column 52. The distillation column preferably comprises a multitray fractionation tower which separates the retorted shale oil product into the desired boiling range materials, for example, gas and water vapor 44, naphtha 46, kerosene 48 and a heavy shale oil bottoms fraction 50. The heavy bottoms fraction removed via line 50 will normally boil above about 465° C. to above about 555° C. and substantially all the remaining fines will be concentrated in this fraction. The heavy fraction will normally also contain the more refractory components of the whole shale oil, thus facilitating downstream treatment of the latter products. In addition to removing the fines which would poison or plug downstream catalytic units, alternatively the retort vapors could be partially condensed with fines present and the heavy oil produced.

The heavy bottoms fraction 50 taken from column 52 is pumped or fed by conventional means to the bottom of the combustor 26 to provide additional energy required to heat the spent shale. Oxidation catalyst is added through line 52 through line 50 and prior to entering the combustor 26. Of course, the particular recycle rate of material through line 50 will depend upon the grade of the shale and can be determined or calculated in a straight-forward manner.

It is contemplated that workers in the art will be able to carry out the present invention in a number of embodiments which do not depart from the spirit and scope of the invention. Such embodiments are considered as equivalents to those disclosed and claimed herein. While the primary utility of the process of this invention is for the retorting of lean oil shale, it will be useful for any oil shale retorting process where supplemental carbonaceous material is added, for example, to conveniently process a coal resource located in the proximity of an oil shale retorting complex.

We claim:

1. A process for retorting oil shale comprising:

(a) heating said oil shale in a retort zone to evolve hydrocarbonaceous vapors therefrom, thereby producing retorted shale;

(b) adding carbonaceous material and a combustion catalyst to the retorted shale, the amount of combustion catalyst being sufficient to increase the combustion rate of the added carbonaceous material to near or above the combustion rate of the retorted shale;

(c) burning the retorted shale, added carbonaceous material in the presence of the added combustion catalyst in a combustion zone; and (d) transferring heat from the combustion zone to heat the oil shale.

2. A process according to claim 1 wherein said shale and added carbonaceous material in said combustion zone are burned to provide hot heat carrier solids and at least a portion of said hot heat carrier solids are mixed with said oil shale to heat said oil shale.

3. A process according to claim 1 wherein said added carbonaceous material comprises coal or devolatilized coal.

4. A process according to claim 1 wherein said carbonaceous material is contacted with said combustion catalyst prior to the addition of said carbonaceous material to said retort zone or to said combustion zone.

5. A process according to claim 3 wherein said coal or devolatilized coal contains sulfur, whereby said combustion results in the formation of $SO_x$ and said combustion zone contains a sufficient ratio of retorted shale to coal to absorb substantially all of said $SO_x$ in the absence of said added combustion catalyst.

6. A process according to claim 3 wherein said coal or devolatilized coal contains sulfur, whereby said combustion results in the formation of $SO_x$, said added combustion catalyst is effective for absorbing said $SO_x$ and present in an amount of at least 5% excess of the amount needed to absorb substantially all of said $SO_x$.

7. A process according to claim 1, 2, 3, 4, 5, or 6 wherein said combustion catalyst comprises an element selected from Groups Ia, IIa, and the transition elements.

8. A process according to claim 7 wherein said combustion catalyst comprises an oxide, carbonate, hydroxide, or organic salt of said element.

9. A process according to claim 7 wherein said combustion catalyst comprises a hydroxide or organic salt of said element.

10. A process according to claim 7 wherein said combustion catalyst is selected from the group of carbonates of sodium, potassium, calcium, and magnesium.

11. A process according to claim 7 wherein said combustion catalyst is selected from the group of sodium, potassium, calcium, or magnesium hydroxides.

12. A process according to claim 7 wherein said retorted shale and added carbonaceous material have a residence time less than about 4 seconds in said combustion zone.

* * * * *

UNITED STATES PATENT AND TRADEMARK OFFICE

CERTIFICATE OF CORRECTION

PATENT NO. : 4,385,983

DATED : May 31, 1983

INVENTOR(S) : Joel W. Rosenthal et al

It is certified that error appears in the above-identified patent and that said Letters Patent are hereby corrected as shown below:

Claim 1, Col. 9, line 25, "(b) adding carbonaceous material" should read --(b) adding supplemental fuel having a burning rate less than the retorted shale--.

Signed and Sealed this

Ninth Day of August 1983

[SEAL]

*Attest:*

GERALD J. MOSSINGHOFF

*Attesting Officer*

*Commissioner of Patents and Trademarks*